United States Patent [19]

Sawa et al.

[11] Patent Number: 4,897,634

[45] Date of Patent: Jan. 30, 1990

[54] SCATTERED-LIGHT SMOKE DETECTOR WITH A SHIELDING STRUCTURE OF DETECTOR CIRCUITS

[75] Inventors: Hiroshi Sawa, Machida; Atsushi Miyabe, Yokohama; Hironobu Kawai, Sagamihara; Hiroshi Honma, Hino, all of Japan

[73] Assignee: Hochiki Kabushiki Kaisha, Tokyo, Japan

[21] Appl. No.: 136,836

[22] Filed: Dec. 22, 1987

[30] Foreign Application Priority Data

Dec. 26, 1986 [JP] Japan ..... 61-310820

[51] Int. Cl.[4] ..... G08B 17/10

[52] U.S. Cl. ..... 340/630; 174/35 R; 361/397; 250/574

[58] Field of Search ..... 340/630, 628; 174/35 R, 174/35 MS; 361/397, 399, 402; 250/573, 574, 575; 356/439

[56] References Cited

U.S. PATENT DOCUMENTS

| | | | |
|---|---|---|---|
| 3,916,209 | 10/1975 | Steele et al. | 340/630 |
| 3,980,997 | 9/1976 | Berns et al. | 340/630 |
| 4,053,785 | 10/1977 | Lee et al. | 340/630 |
| 4,121,110 | 10/1978 | Solomon | 340/630 |
| 4,386,388 | 5/1983 | Beun | 174/35 MS |
| 4,438,428 | 3/1984 | Ober et al. | 340/630 |
| 4,584,485 | 4/1986 | Powers et al. | 250/239 |
| 4,728,801 | 3/1988 | O'Connor | 340/630 |
| 4,758,733 | 7/1988 | Mochizuki | 356/439 |
| 4,770,921 | 9/1988 | Wacker et al. | 361/402 |
| 4,801,489 | 1/1989 | Nakagawa | 174/35 R |

*Primary Examiner*—Joseph A. Orsino
*Assistant Examiner*—Jill D. Jackson
*Attorney, Agent, or Firm*—Max Fogiel

[57] ABSTRACT

A scattered-light smoke detector having an improved shield structure. A detector circuit is provided on a printed circuit board which is disposed at an upper portion of a smoke detecting section. The smoke detecting section includes a planar base and a surrounding wall extending downwardly from a lower surface of the base and having an opening or openings which allows or allow smoke to enter therethrough. The surrounding wall defines a smoke detecting space therein. A light emitting element and a photodetector element which are disposed at positions where they are not opposite each other and optical axes thereof intersect each other at a predetermined angle and said photodetector element can receive light from the light emitting element scattered by smoke entering the smoke detecting space. The printed circuit board is attached on an upper surface of the base. A shield layer is interposed between said printed circuit board and said base. Electric and/or electronic parts are formed in chips and packaged on an upper surface of the printed circuit board. A shield case is disposed so that it covers the electric and/or electronic parts.

7 Claims, 4 Drawing Sheets

RELATIVE ART

SCATTERED-LIGHT SMOKE DETECTOR WITH A SHIELDING STRUCTURE OF DETECTOR CIRCUITS

FIELD OF THE INVENTION

This invention relates to a scattered-light smoke detector and more particularly to a novel shape and configuration of the smoke detector.

RELATIVE ARTS

Recently, many attempts have been made to reduce a size and thickness of a scattered-light smoke detector in view of its beauty appearance when it is fitted in a building. For this purpose, for instance, electric/electronic parts constituting detector circuits are mounted in a free space on an smaller-angle side of an intersection of optical axes between a light emitting element and a photodetector element which are disposed in a smoke detecting section as well as on a behind surface of a surface on which the light emitting element and the photodetector element are provided.

However, efforts has further been made to reduce the size and thickness of the smoke detecting section itself for further effecting the efforts for reducing the size and thickness of the detector. As a result of this, it has become difficult to incorporate the electric/electronic parts constituting the detector circuits into the free space of the smoke detecting section.

It might then be contemplated, as shown in FIG. 6, that a printed circuit board 58 is disposed centrally in a circuit incorporating space 56 which is formed at an upper portion of a smoke detecting section 54 provided with a light emitting section and a light receiving section 52; chipped resisters and chiped transistors 62 are packaged on an upper surface of the printed circuit board 58; relatively bulky electric/electronic parts 64 such as a capacitor are packaged on a lower surface of the printed circuit board 58; and shield cases 60 and 70 are provided above and below the double-sided printed circuit board 58.

In this configuration, however, since the electric/electronic parts are packaged both on the opposite sides of the printed circuit board, respectively, both the shield cases 60 and 70 are needed for above and below the printed circuit board 58, respectively. For this reason, the reduction in size and thickness of the detector is limited and desired small-sized detector has not yet been realized.

This structural problem causes another problem that the number of the parts and accordingly the number of assembling steps are increased due to the two shield cases, increasing the cost of the detector.

SUMMARY OF THE INVENTION

The present invention has been made with a view to solving the problems as described above and it is an object of the present invention to provide a scattered-light smoke detector which is capable of reducing the size and thickness of a shielding structure of detector circuits so as to cope with the recent small-sization of the smoke detecting section.

It is another object of the present invention to provide a scattered-light smoke detector which is further capable of reducing the size and thickness of a space for accommodating electric/electronic parts constituting the detector circuit.

In a scattered-light smoke detector, a detector circuit is provided on a printed circuit board which is disposed at an upper portion of a smoke detecting section. The smoke detecting section includes a planar base and a surrounding wall extending downwardly from a lower surface of the base and having an opening or openings which allows or allow smoke to enter therethrough. The surrounding wall defines a smoke detecting space therein. A light emitting element and a photodetector element which are disposed at positions where they are not opposite each other and optical axes thereof intersect each other at a predetermined angle and said photodetector element can recieve light from the light emitting element scattered by smoke entering the smoke detecting space. The printed circuit board is attached on an upper surface of the base. A shield layer is interposed between said printed circuit board and said base. Electric and/or electronic parts are formed in chips and packaged on an upper surface of the printed circuit board. A shield case is disposed so that it covers the electric and/or electronic parts.

With this arrangement, the scattered-light smoke detector of the present invention enables the shield layer to shield the lower surface of the printed circuit board and realizing the shielding of the detector circuits packaged on the printed circuit board without providing a separate shield case.

According to one preferred mode of the present invention, the shield layer is made of an electrically-conductive metal foil. This metal foil may be integrally attached or deposited on the printed circuit board by various known means. The metal foil may for example copper foil.

In accordance with another embodiment, the shield layer may be a separate electrically-conductive metal plate from said printed circuit board and said base. In this case, the metal may be copper or alminum.

In accordance with more another embodiment, a casing for accommodating therein only a capacitor which constitutes a detecting circuit together with said electric and/or electronic parts and which may not be influenced by noises, and said casing is provided within said smoke detecting space on an smaller-angle side of an intersection between the optical axes of the light emitting element and the photodetector element.

In accordance with more further embodiment, the surrounding wall is formed by a plurality of substantially L-shaped wall elements and the capacity accommodating casing which are arranged circumferentially at predetermined intervals.

In this embodiment, there is no need to save a space for accommodating the electric/electronic parts between the smoke detecting section and the printed circuit board. This substantially reduces the space especially in thickness for accommodating the circuitry. In addition, a lead wire for the photodetector element provided in the smoke detecting section can be shortened, so that possible electrical noise picked up by the lead wire can be reduced, improving S/N (signal-to-noise ratio) of the photo-output.

In the specifications and claims, the wordings "upper" and "lower" are used to specify a "surface" of the base or the printed circuit board. These wordings are used because a detector of this type is generally installed on a ceiling. However, these wordings may signify differently from their exact explicit meanings according to the places where the detector is installed.

DESCRIPTION OF PREFERRED EMBODIMENT OF THE INVENTION

Figure 1:
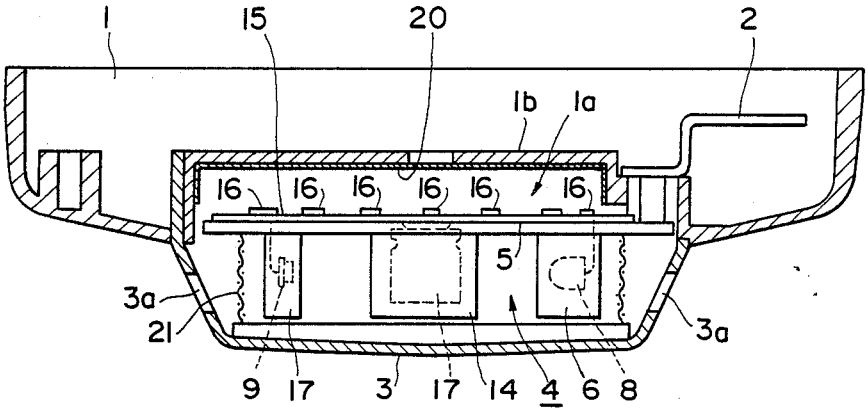
FIG. 1 is a vertical sectional view of a scattered-light smoke detector embodying the present invention.

Referring to FIG. 1, a cover 1 constituting a detector body is open at a top thereof and it is removably fitted to a connecting terminal of a detector base (not shown) which is fixed to a surface such as a ceiling through a connecting terminal 2 provided in the top opened space of the cover 1. An outer cover having openings for introducing smoke thereinto is fitted to the cover 1 at its lower central portion. A smoke detecting section 4 is mounted within the outer cover 3.

Figure 2:
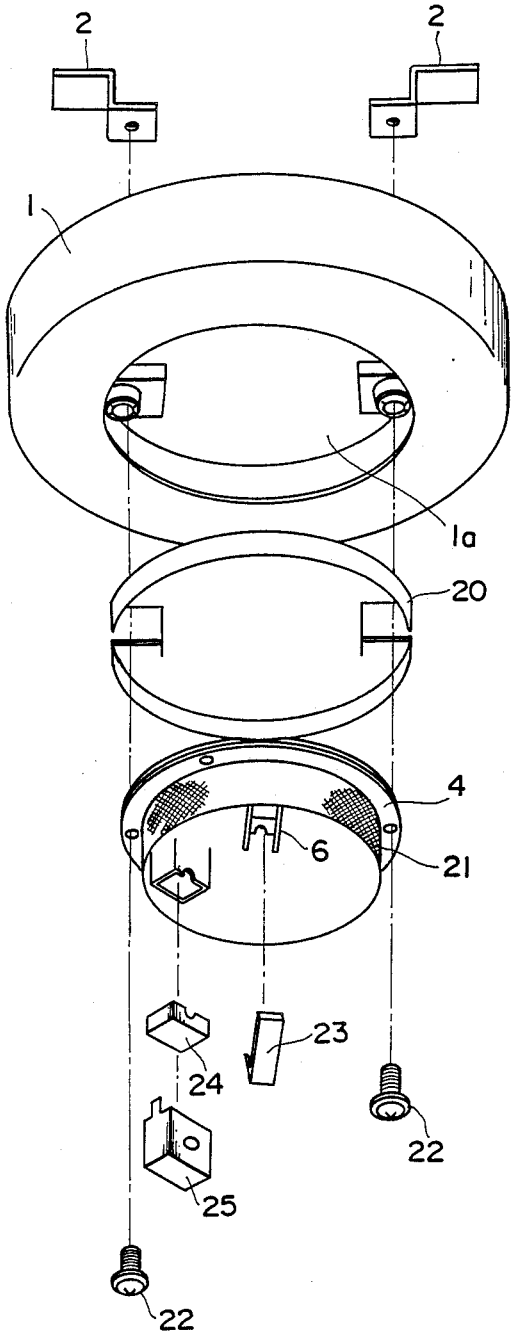
FIG. 2 is a partially exploded perspective view of the scattered-light smoke density of FIG. 1.

FIG. 2 show the cover 1 having a circuitry encasing space 1*a* which opens at a bottom thereof. The smoke detecting section 4 is fitted in the circuitry encasing space 1*a* through a shielding case 20, which is interposed therebetween. A metal mesh member 21 is attached at an outer periphery of the smoke detecting section 4 around a surrounding wall of the section 4. The shield case 20 and the smoke detecting section 4 are fixed to the cover 1 by applying a screw to the connecting terminal positioned at an upper portion of the cover 1.

Figure 3:
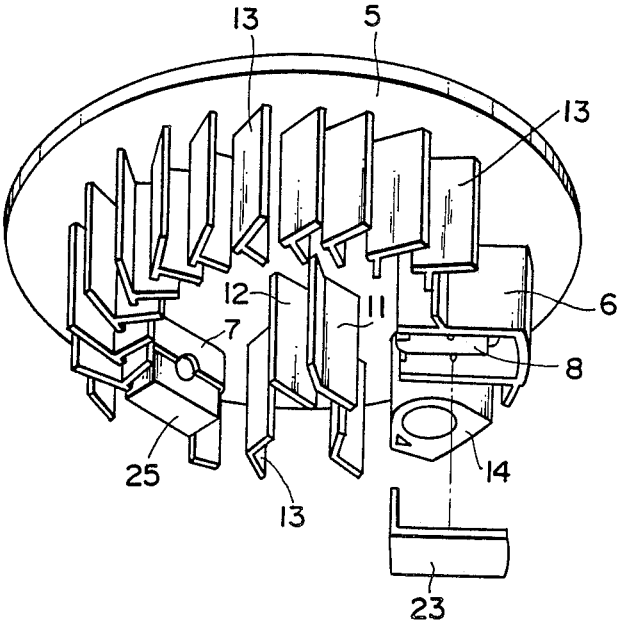
FIG. 3 is a perspective view of a smoke detecting section employed in the scattered-light smoke density of FIG. 1 as viewed from the bottom thereof.
Figure 4:
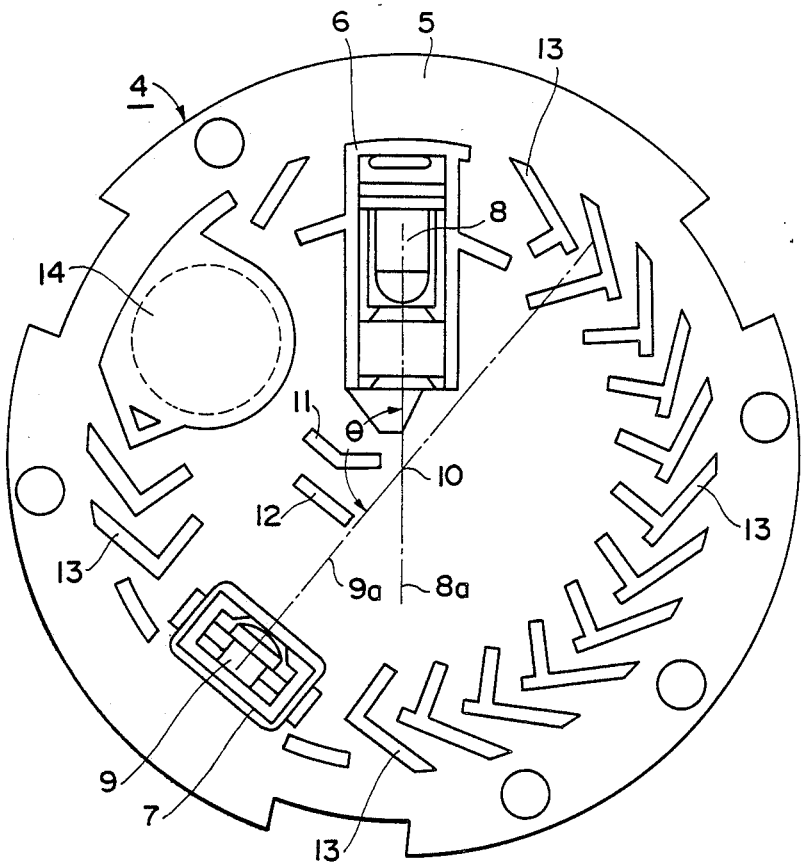
FIG. 4 is a plan view of the smoke detecting section of FIG. 3 as viewed from the bottom thereof.

FIGS. 3 and 4 illustrates a base 5 which is disposed at an upper space portion of the smoke detecting section 4. A holder 6 for a light emitting section and a holder 7 for a light receiving section are integrally formed on a bottom surface of the base 5. The holder 6 accommodates a light emitting element 8 therein, while the holder 7 accommodates a photodetector element 9 therein. The light emitting element 8 and the photodetector element 9 are so disposed that they are deviated, by predetermined angle, from positions where they are opposite each other. For instance, an intersecting angle (an smaller one) $\theta$ between optical axes 8*a* an 9*a* is set at 135°.

A shading member 11 is provided near an intersection 10 of the optical axes 8*a* and 9*a* on an smaller-angle side of the intersection 10, so that light emitted from the light emitting element 8 may not directly enter the photodetector element 9. Another shading member 12 is provided adjacent to the shading member 11. The shading member 12 prevents refracted light, which is possibly caused by drops of dew produced at a tip end of the shading member 11 by moisture condensation, from being incident upon the photodetector element 9.

The surrounding wall of the smoke detecting section 4 including the light emitting element 8 and the photodetector element 9 is formed by a plurality of L-shaped wall elements 13. The wall elements 13 are arranged circumferentially at predetermined intervals. A capacitor casing 14 is formed in the surrounding wall on the left side of the light emitting section holder 6 and the light receiving section holder 7 (as viewed in FIG. 4), i.e., on the smaller-angle side of the optical axes 8*a* and 9*a*.

Referring again to FIG. 1, a double-sided printed circuit board 15 is attached to the top of the base 5.

Figure 5:
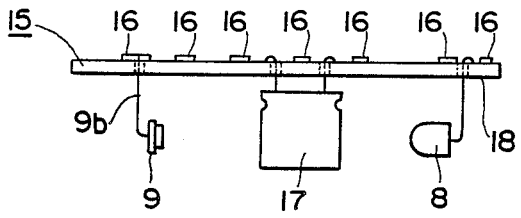
FIG. 5 is a schematic side elevational view of a double-sided printed circuit board in which an electric/electronic parts are packaged shown in FIG. 1.

Electric/electronic parts 16 which provide detector circuit pattern in chip forms are packaged on an upper side of the double-sided printed circuit board 15 as shown in FIG. 5. The other side, lower side of the double-sided printed circuit board 15 has a capacitor 17 packaged thereon together with the light emitting element 8 and the photodector element 9. In addition, a copper foil 18 is attached to the lower side of the double-sided printed circuit board 15 all over its surface. This copper foil 18 functions as a shielding plate of the lower side of the double-sided printed circuit board 15.

In this connection, it is to be noted that most of the electric/electronic parts which constitute the detector circuits are formed in chips, but the electrolytic capacitor for stabilizing power supply is difficult to be formed in a chip because of capacity and reliability. For this reason, the capacitor is mounted in the capacitor casing 14 which is formed integrally with the smoke detecting section 4. In other word, all electrical/electronic parts other than the capacitor which are employed in the present invention for consituting the circuitry of the detector are formed in chips.

The upper portion of the smoke detecting section 4 above the double-sided printed circuit board 15 is covered by the shield case 20. The electric/electronic parts 16 are encased in the shield case 20. This shield case 20 is fitted in and fixed to a circuit encasing portion 1*b* which is formed integrally with the cover 1.

Reference is again made to FIGS. 2 and 3, in which a cover 23 is fitted to the holder 6 for the light receiving section of the smoke detecting section 4 and similarly a cover 24 is fitted to the holder of the light receiving section 7. This light receiving section holder 7 is further fitted with a shield case 25 of a metal.

Figure 6:
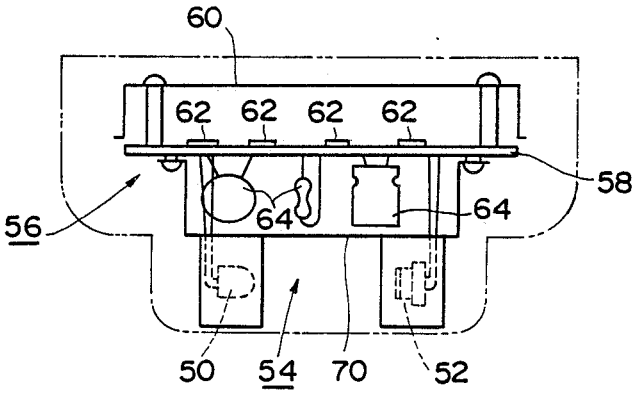
FIG. 6 is a vertical sectional view of a relative art similar to FIG. 1.

Thus, all the electric/electronic parts 16 constituting the detector circuits 17 other than the capacitor, which may not be influenced by noises, are formed in chips and packaged on the upper surface of the double-sided printed circuit board 15. As a result of this, the lower surface of the double-sided printed circuit board 15 is all flatly covered with copper foil to impart it with a shielding function. Therefore, a shield case may be omitted in the lower side of the double-sided printed circuit board when the components are assembled as illustrated in FIG. 1. Only the shield case 20 is needed in the upper side of the double-sided printed circuit board 15 on which the electric/electronic parts in chip forms are packaged. This can highly simplify the configuration of the shield. Moreover, since there is no need to provide a shield case between the double-sided printed circuit board 15 and the smoke detecting section 4, the space for accommodating the circuits can be made thinner as compared with that of a smoke detector as illustrated in FIG. 6. As a result of this, the entire size and thickness of the smoke detector can be reduced very much due to small-sization and reduction in thickness of the smoke detecting section.

Furthermore, since a shield case may be omitted from between the double-sided printed circuit board 15 and the smoke detecting section 4, the distance between the photodetector element 9 and the double-sided printed circuit board 15 can be shortened. This allows the length of a lead line 9b for the photodetector element 9 to be reduced and a possibility of getting noises can be reduced as compared with a longer lead line. Thus, a noise level of a photo-output is lowered to enhance S/N (signal-to-noise ratio).

The shield case above the double-sided printed circuit board 15 may alternatively be provided by metallizing the inner surface of the circuit encasing portion 1b of the cover 1 or coating an electrically-conductive material.

We claim:

1. A scattered-light smoke detector comprising:

a smoke detecting section including a planar base and a surrounding wall extending downwardly from a lower surface of said base and having at least one opening allowing smoke to enter therethrough, said surrounding wall defining a smoke detecting space therein;

a light emitting element and a photodetector element disposed at positions where they are not opposite each other and optical axes thereof intersect each other at a predetermined angle and said photodetector element can recieve light from the light emitting element scattered by smoke entering said smoke detecting space;

a printed circuit board attached on an upper surface of said base;

a shield layer interposed between said printed circuit board and said base, said shield layer comprising an electrically conductive material on a lower surface of said printed circuit board;

electrical parts formed in chips and packaged on an upper surface of the printed circuit board; said light emitting element and said photodetector element as well as said electrical parts passing through said base and said printed circuit board and being connected on an upper surface of said printed circuit board and a shield case disposed so that it covers said electrical parts;

said electrically conductive material being flat on the lower surface of said printed circuit board; said shield layer being an electrically-conductive metal plate; said shield case comprising an electrically-conductive material coating on the inner surface of said case; a casing for accommodating therein a capacitor operating as a detecting circuit together with said electrical parts, said casing being located within said smoke detecting space at a side of said light emitting element and a side of said photodetector element, said casing being spaced from the optical axis of said light emitting element and from the optical axis of said photodetector element; said surrounding wall being formed by a plurality of substantially L-shaped wall elements and said casing, said L-shaped wall elements being arranged circumferentially at predetermined intervals.

2. A scattered-light smoke detector comprising:

a smoke detecting section including a planar base and a surrounding wall extending downwardly from a lower surface of said base and having at least one opening allowing smoke to enter therethrough, said surrounding wall defining a smoke detecting space therein:

a light emitting element and a photodetector element disposed at positions where they are not opposite each other and optical axes thereof intersect each other at a predetermined angle and said photodetector element can recieve light from the light emitting element scattered by smoke entering said smoke detecting space;

a printed circuit board attached on an upper surface of said base;

a shield layer of an electrically-conductive metal foil, said shield layer comprising an electrically-conductive metal foil on a lower surface of said printed circuit board and located between said printed circuit board and said base;

electrical parts formed in chips and packaged on an upper surface of the printed circuit boards; said light emitting element and said photodetector element as well as said electrical parts passing through said base and said printed circuit board and being connected on an upper surface of said printed circuit board and a shield case disposed so that it covers said electrical parts;

a casing for accommodating therein a capacitor operating as a detecting circuit together with said electrical parts, said casing being located within said smoke detecting space at a side of said light emitting element and a side of said photodetector element, said casing being spaced from the optical axis of said light emitting element and from the optical axis of said photodetector element;

said surrounding wall being formed by a plurality of substantially L-shaped wall elements and said casing, said L-shaped wall elements being arranged circumferentially at predetermined intervals.

3. A scattered-light smoke detector comprising:

a smoke detecting section including a planar base and a surrounding wall extending downwardly from a lower surface of said base and having at least one opening allowing smoke to enter therethrough, said surrounding wall defining a smoke detecting space therein;

a light emitting element and a photodetector element disposed at positions where they are not opposite each other and optical axes thereof intersect each other at a predetermined angle and said photodetector element can receive light from the light emitting element scattered by smoke entering said smoke detecting space;

a printed circuit board attached on an upper surface of said base;

a shield layer of an electrically-conductive metal foil, said shield layer comprising an electrically-conductive metal foil on a lower surface of said printed circuit board and located between said printed circuit board and said base;

electrical parts formed in chips and packaged on an upper surface of the printed circuit board; said light emitting element and said photodetector element as well as said electrical parts passing through said base and said printed circuit board and being connected on an upper surface of said printed circuit board and a shield case disposed so that it covers said electrical parts;

a casing for accommodating therein a capacitor operating as a detecting circuit together with said electrical parts, said casing being located within saifd smoke detecting space at a side of said light emitting element and a side of said photodetector element, said casing being spaced from the optical axis of said light emitting element and from the optical axis of said photodetector element.

4. A scattered-light smoke detector as claimed in claim 3, wherein said metal foil is flat on the lower surface of the printed circuit board.

5. A scattered-light smoke detector as claimed in claim 3, wherein said shield case comprises an electrically-conductive material coating on the inner surface of said case.

6. A scattered-light smoke detector as defined in claim 3, wherein said surrounding wall is formed by a plurality of wall elements and said casing, said wall elements being arranged circumferentially at predetermined intervals.

7. A scattered-light smoke detector as defined in claim 3, wherein said surrounding wall is formed by a plurality of substantially L-shaped wall elements and said casing, said L-shaped wall elements being arranged circumferentially at predetermined intervals.

* * * * *